US009548570B2

(12) United States Patent
Laurx et al.

(10) Patent No.: US 9,548,570 B2
(45) Date of Patent: Jan. 17, 2017

(54) DIRECT BACKPLANE CONNECTOR

(71) Applicant: Molex, LLC, Lisle, IL (US)

(72) Inventors: John Laurx, Aurora, IL (US); Vivek Shah, Buffalo Grove, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/907,451

(22) PCT Filed: Jul. 23, 2014

(86) PCT No.: PCT/US2014/047856

§ 371 (c)(1),
(2) Date: Jan. 25, 2016

(87) PCT Pub. No.: WO2015/013430

PCT Pub. Date: Jan. 29, 2015

(65) Prior Publication Data

US 2016/0181732 A1 Jun. 23, 2016

Related U.S. Application Data

(60) Provisional application No. 61/857,513, filed on Jul. 23, 2013.

(51) Int. Cl.

| | |
|---|---|
| ***H01R 13/6471*** | (2011.01) |
| ***H01R 13/41*** | (2006.01) |
| ***H01R 13/514*** | (2006.01) |
| ***H01R 13/6587*** | (2011.01) |

(52) U.S. Cl.
CPC ..... *H01R 13/6471* (2013.01); *H01R 13/41* (2013.01); *H01R 13/514* (2013.01); *H01R 13/6587* (2013.01)

(58) Field of Classification Search
CPC . H01R 13/41; H01R 13/6587; H01R 13/6471; H01R 13/514
See application file for complete search history.

(56) References Cited

U.S. PATENT DOCUMENTS

| | | | | |
|---|---|---|---|---|
| 6,899,566 | B2 * | 5/2005 | Kline | H01R 13/514 439/108 |
| 7,094,102 | B2 * | 8/2006 | Cohen | H05K 1/14 439/607.08 |
| 8,628,356 | B2 | 1/2014 | Laurx et al. | |
| 2003/0143894 | A1 | 7/2003 | Kline et al. | |
| 2007/0155241 | A1 | 7/2007 | Lappohn | |
| 2010/0144165 | A1 | 6/2010 | Fowler et al. | |
| 2011/0143591 | A1 * | 6/2011 | Davis | H01R 13/6587 439/607.27 |
| 2012/0135641 | A1 | 5/2012 | Okuyama et al. | |
| 2012/0184140 | A1 | 7/2012 | Davis et al. | |

* cited by examiner

*Primary Examiner* — Briggitte R Hammond
(74) *Attorney, Agent, or Firm* — Stephen L. Sheldon

(57) ABSTRACT

A connector is configured to provide a mating side that includes a 90 degree rotation about two different axis when compared to a mounting. The connector, when mounted on a first circuit board is thus suitable for directly mating to a right-angle connector that is mounted on a second circuit board, the second circuit board at a being at a 90 angle to the first circuit board. The connector can include a shroud that supports a u-shield that partially shields contacts positioned in the mating side.

15 Claims, 24 Drawing Sheets

DIRECT BACKPLANE CONNECTOR

RELATED APPLICATIONS

This application is a national phase of PCT Application No. PCT/US2014/047856, filed Jul. 23, 2014, which in turn claims priority to U.S. Provisional Application No. 61/857,513, filed Jul. 23, 2013, which is incorporated herein by reference in its entirety.

FIELD OF THE INVENTION

The present invention relates to field of connectors that mount on a circuit board, more specifically to a connector suitable for use in a backplane application.

DESCRIPTION OF RELATED ART

Connectors suitable for backplanes are often specialized for their environment. Backplane connectors need to have reasonably high density (sometimes referred to as pins per inch) while supporting data channels that have high signaling frequencies. These conflicting requirements make backplane connectors challenging to design, particularly for applications where the channels need to support data rates of 20 Gbps or more (using NRZ encoding).

While a variety of connector configurations are possible, including right angle, mid-plane and mezzanine style connectors, one common application of such connector is known as an ortho mid-plane application. This application relates to the idea that a daughter card will be orthogonally orientated compared to a main board. In the past, such applications required the use of a mid-plane board to help bridge the connection between the daughter card and the main board. For example, the daughter card would have a right angle connector, the main board would have a right angle connector and the main board and the daughter card could be orientated so that two aspects of the main boards are rotated 90 degrees with respect to the daughter card. A mid-plane circuit board would be positioned at 90 degrees from both the main board and the daughter card and the mid-plane could include header connectors on both sides of the mid-plane. Thus, the corresponding header could engage the corresponding right-angle connector so as to help bridge the connection between the daughter card and the main board. The terminals in the headers could share the same vias on the mid-plane board, as is known in the art, so as to allow the electrical to pass through the mid-plane board appropriately.

It has been determined that for certain applications the mid-plane board is undesirable. One issue is that the existence of the mid-plane board makes it more complex to manage air flow in a resulting device. Another issue is that it is difficult to maintain consistent impedance through the first right angle connector, the header, the mid-plane board, the other header and the second right angle connector. Thus, resulting impedance discontinuities tended to introduce significant loss in the channel. One solution has been to use an adaptor to help bridge the needed orientation change while lessening impedance discontinuities and an example of such a design is disclosed in U.S. application Ser. No. 13/503,516, filed Apr. 23, 2012 and which is incorporated herein by reference in its entirety. For certain applications, however, further improvements would be appreciated.

BRIEF SUMMARY

A backplane connector system is disclosed that allows two right angle connectors to mate directly to each other without a secondary connector. One of the right angle connectors includes terminals with an edged-coupled alignment that has a 90 degree rotation at a mating side. A shroud is provided to help provide desirable electrical performance and to help maintain impedance and cross-talk levels in a mating side of the right angle connector with the contacts having the 90 degree rotation in alignment.

In an embodiment, a connector includes a plurality of wafers, each wafer including a first pair and a second pair of signal terminals with a ground terminal positioned between the first and second pairs, each of the terminals of the pair of signal terminals having a tail, a body and a contact, wherein the tails of the terminals are arranged in the wafer are arranged in a row and the bodies of the signal terminals edge-coupled and are aligned in a first alignment such that the body of the ground terminal is between the bodies of the two pairs of signal terminals and the contacts of each pair of signal terminals have a transition are so that the contacts are edge-coupled in a second alignment that is 90 degrees different than the first alignment. Each wafer can including a shield that is electrically connected to the ground terminal and a shroud that is positioned on a mating side of the wafers. The shroud is insulative and including apertures that support the contacts in the second alignment and further includes supports u-shields. The u-shields can be configured to partially shield a respective pair of contacts are electrically connected to the ground terminal. An insert can be positioned in the shroud and the insert can help electrically connect the u-shield to at least one of the ground terminal and shield.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
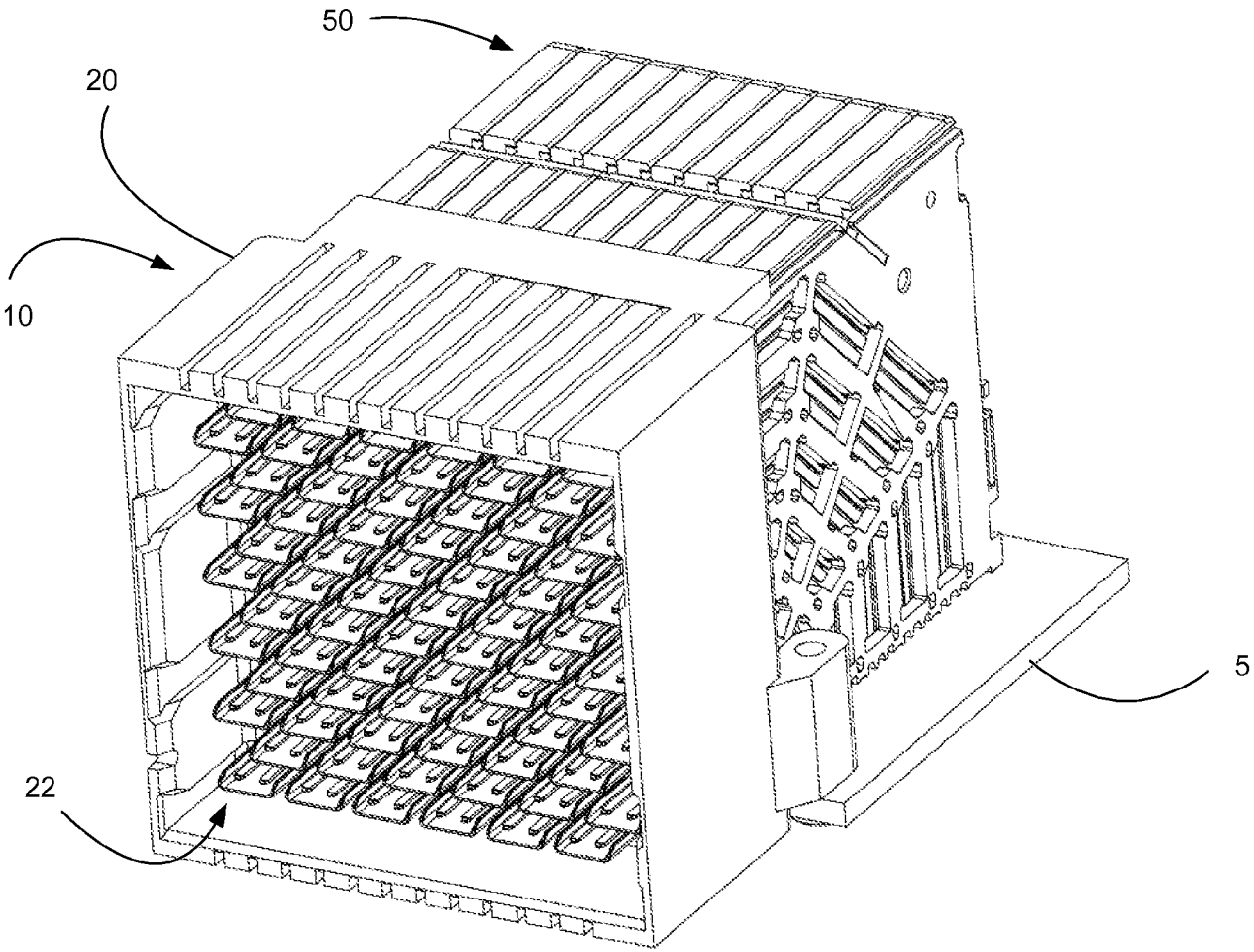
FIG. 1 illustrates a perspective view of an embodiment of a connector.
Figure 2:
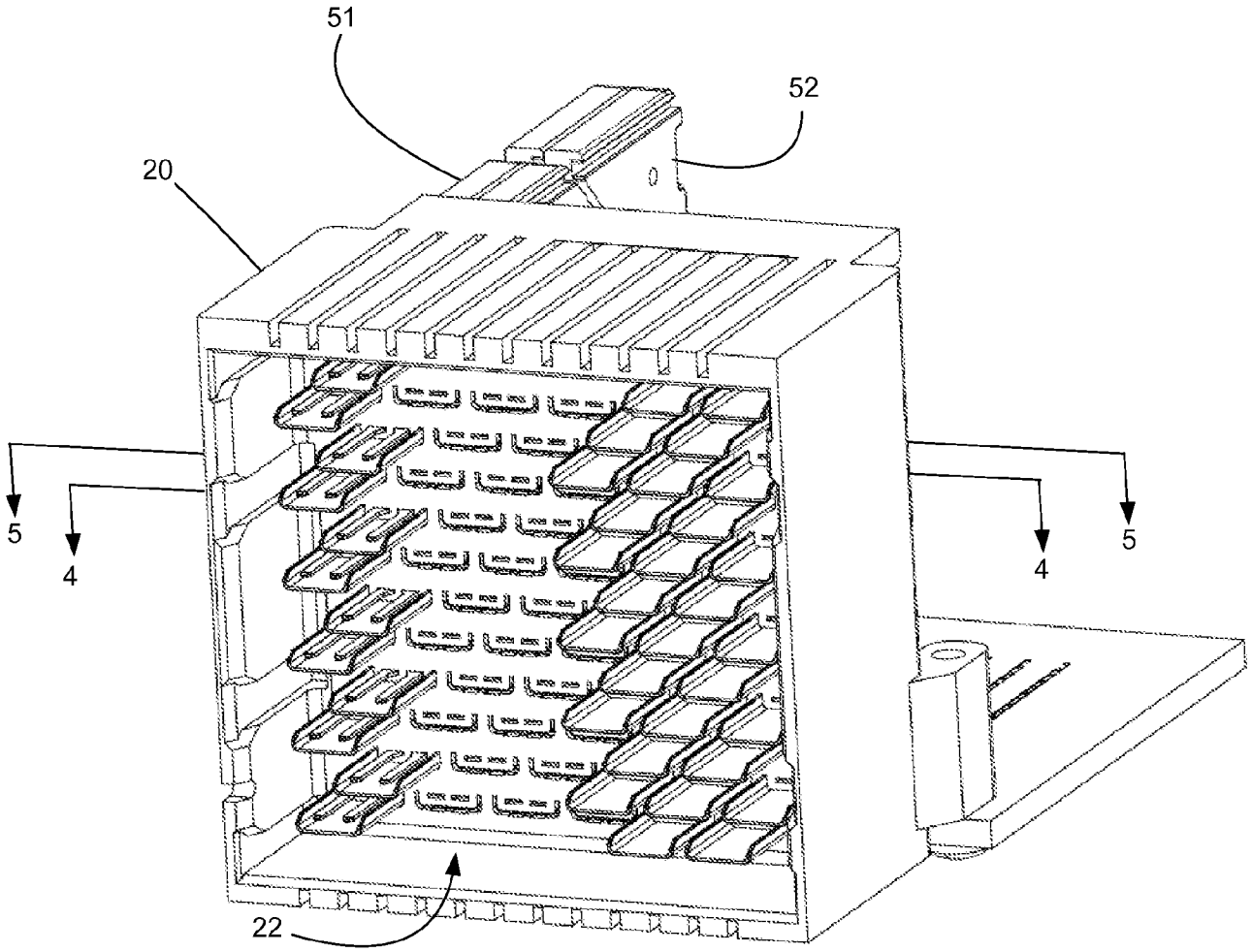
FIG. 2 illustrates a perspective view of a simplified version of the embodiment depicted in FIG. 1.
Figure 3:
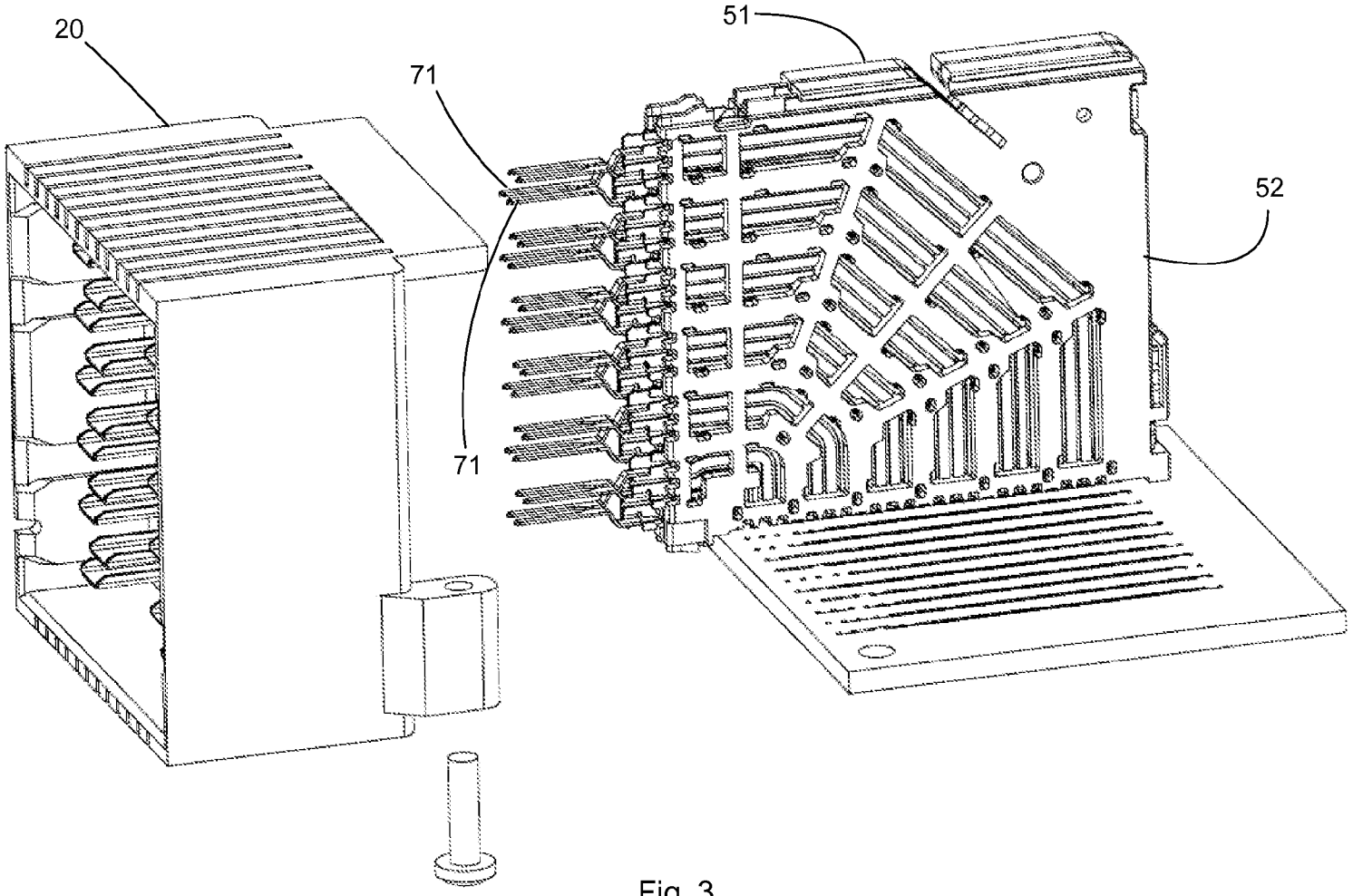
FIG. 3 illustrates a perspective partially exploded view of the embodiment depicted in FIG. 3.
Figure 4:
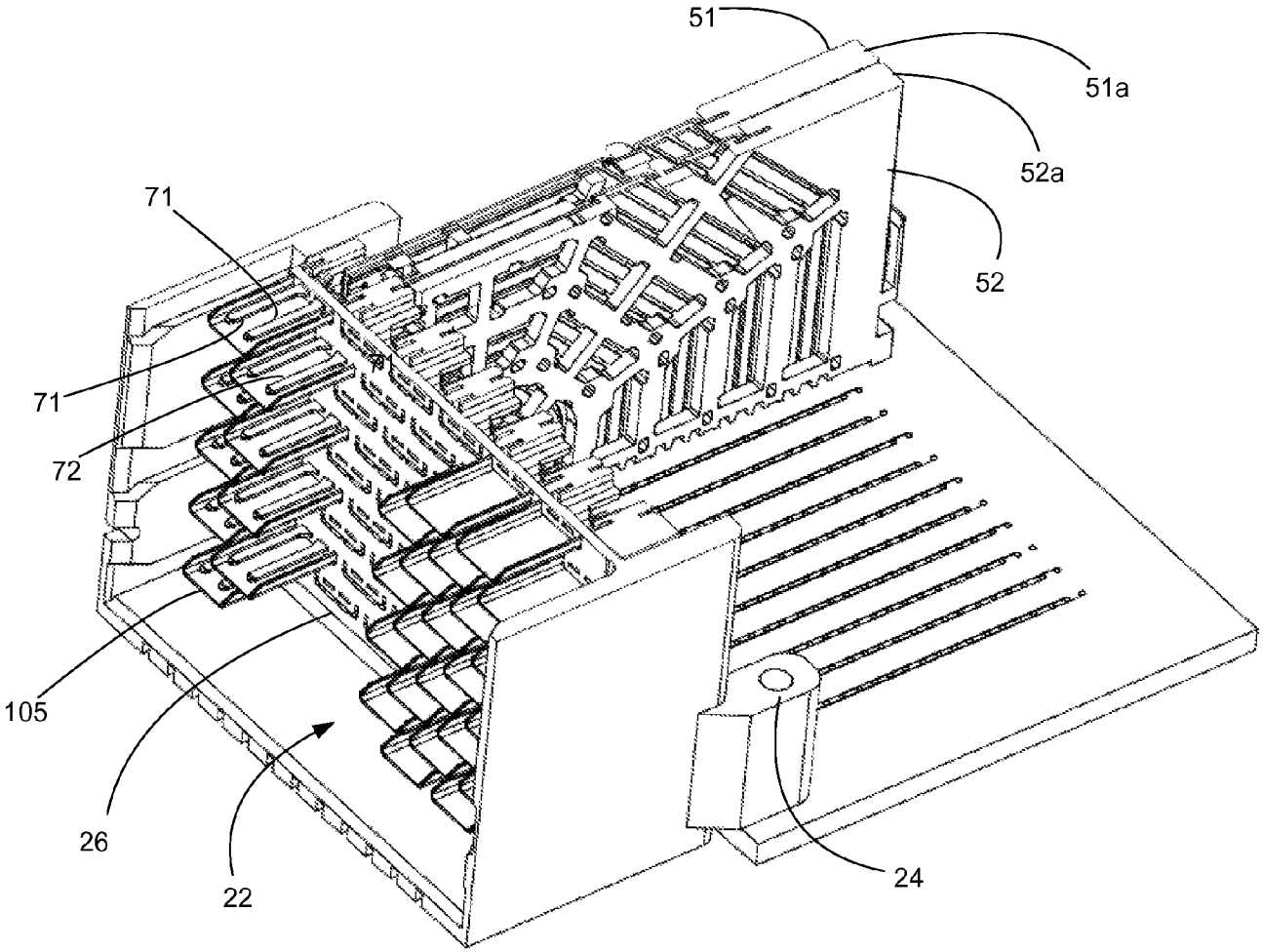
FIG. 4 illustrates a perspective view of a cross section of the embodiment depicted in FIG. 2, taken along line 4-4.
Figure 5:
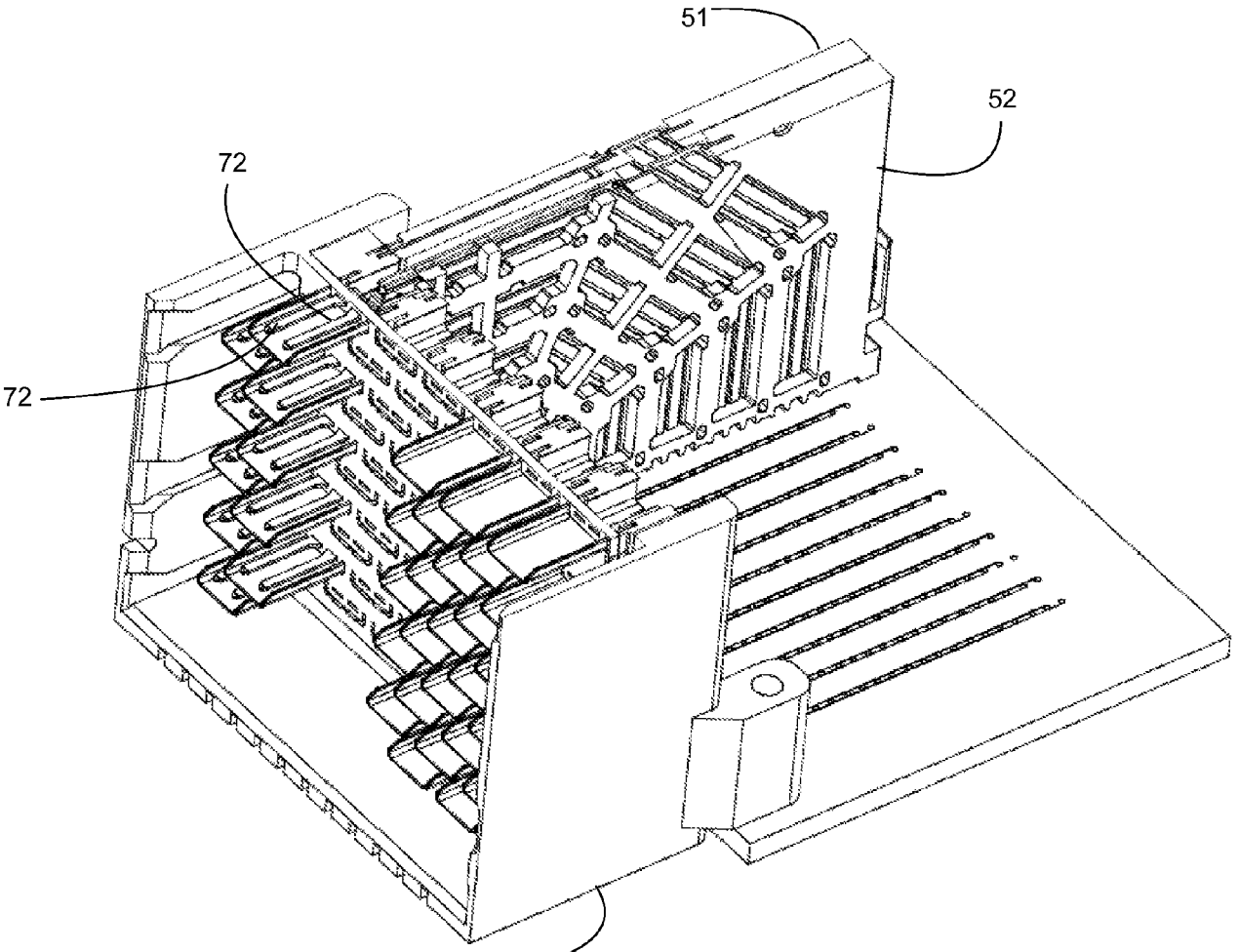
FIG. 5 illustrates a perspective view of a cross section of the embodiment depicted in FIG. 2, taken along line 5-5.
Figure 6:
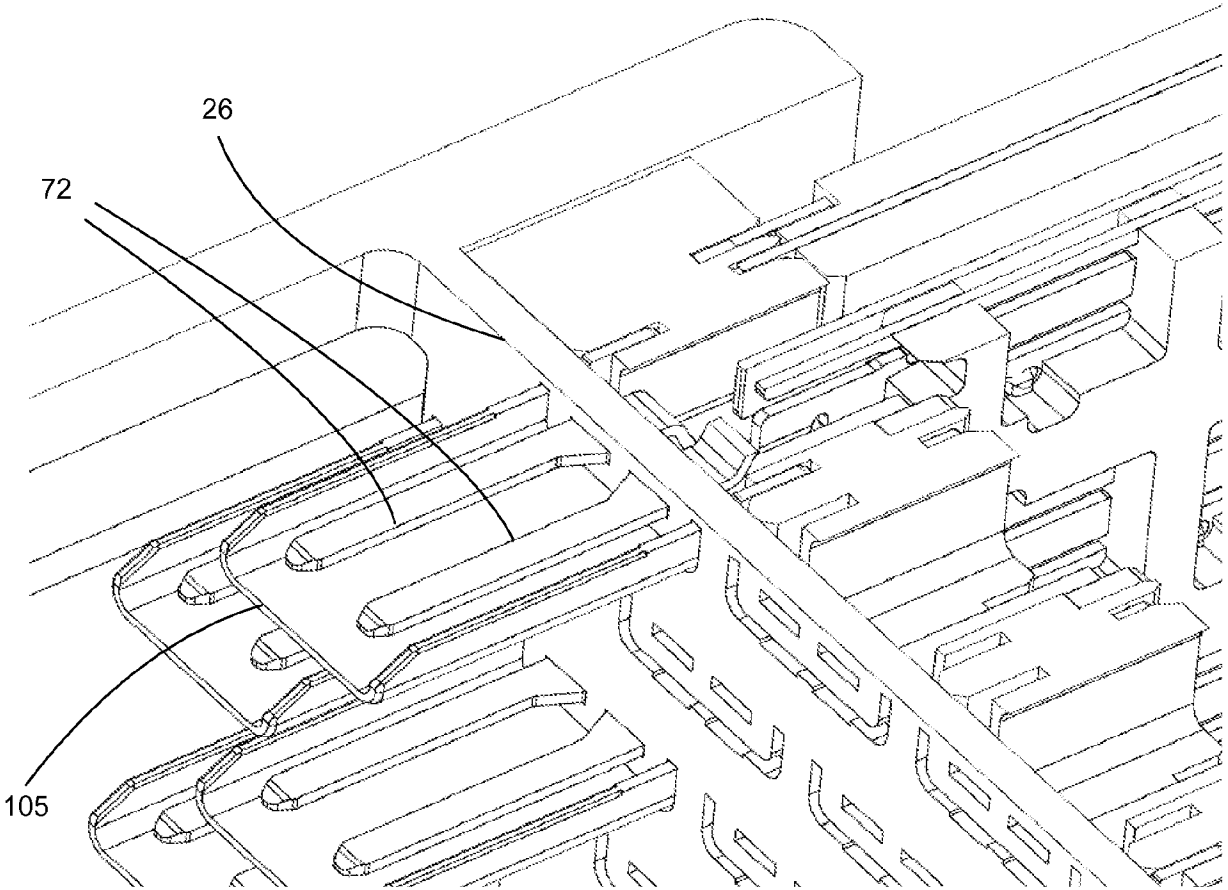
FIG. 6 illustrates a perspective enlarged view of the embodiment depicted in FIG. 5.
Figure 7:
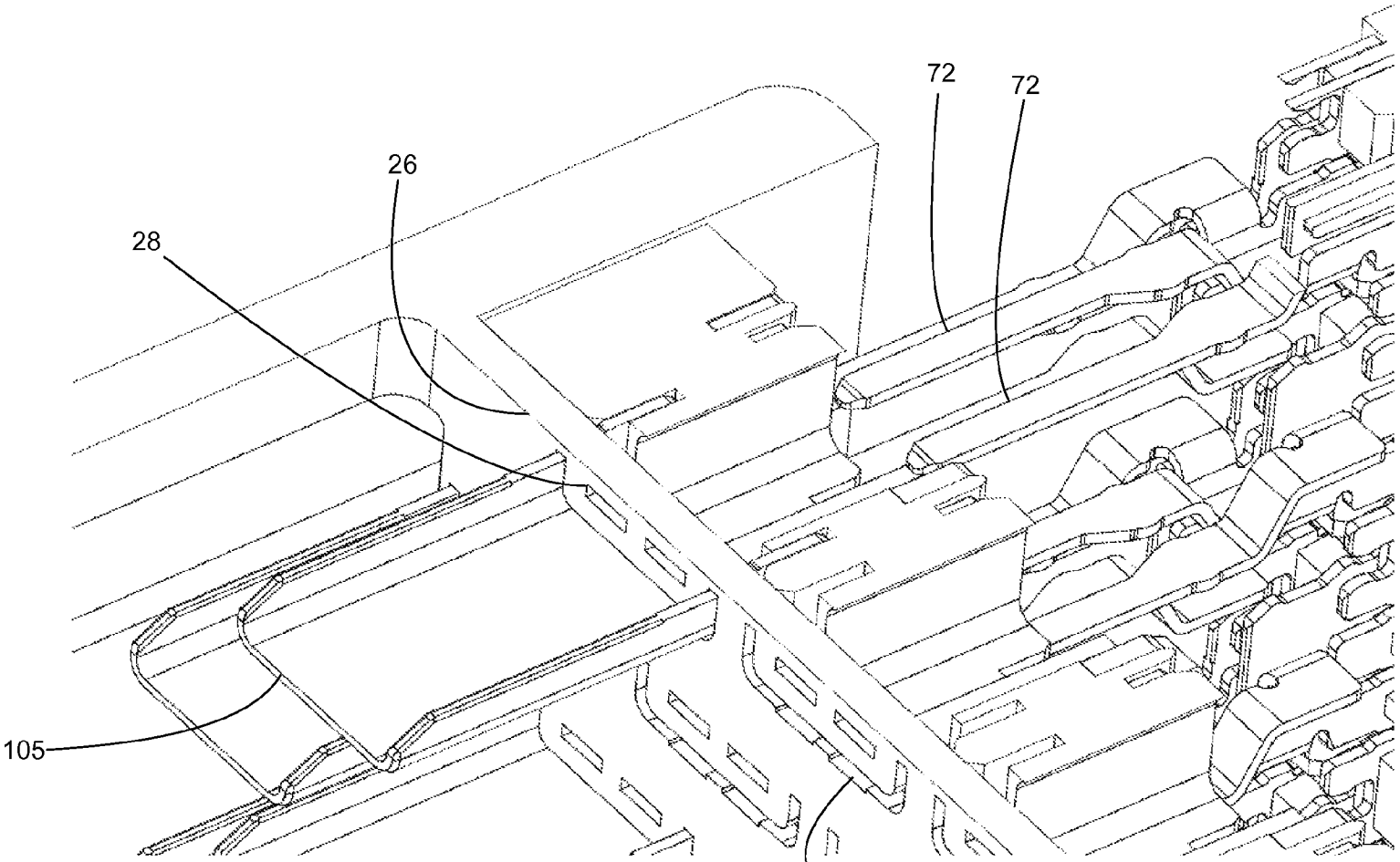
FIG. 7 illustrates a perspective simplified view of the embodiment depicted in FIG. 6.
Figure 8:
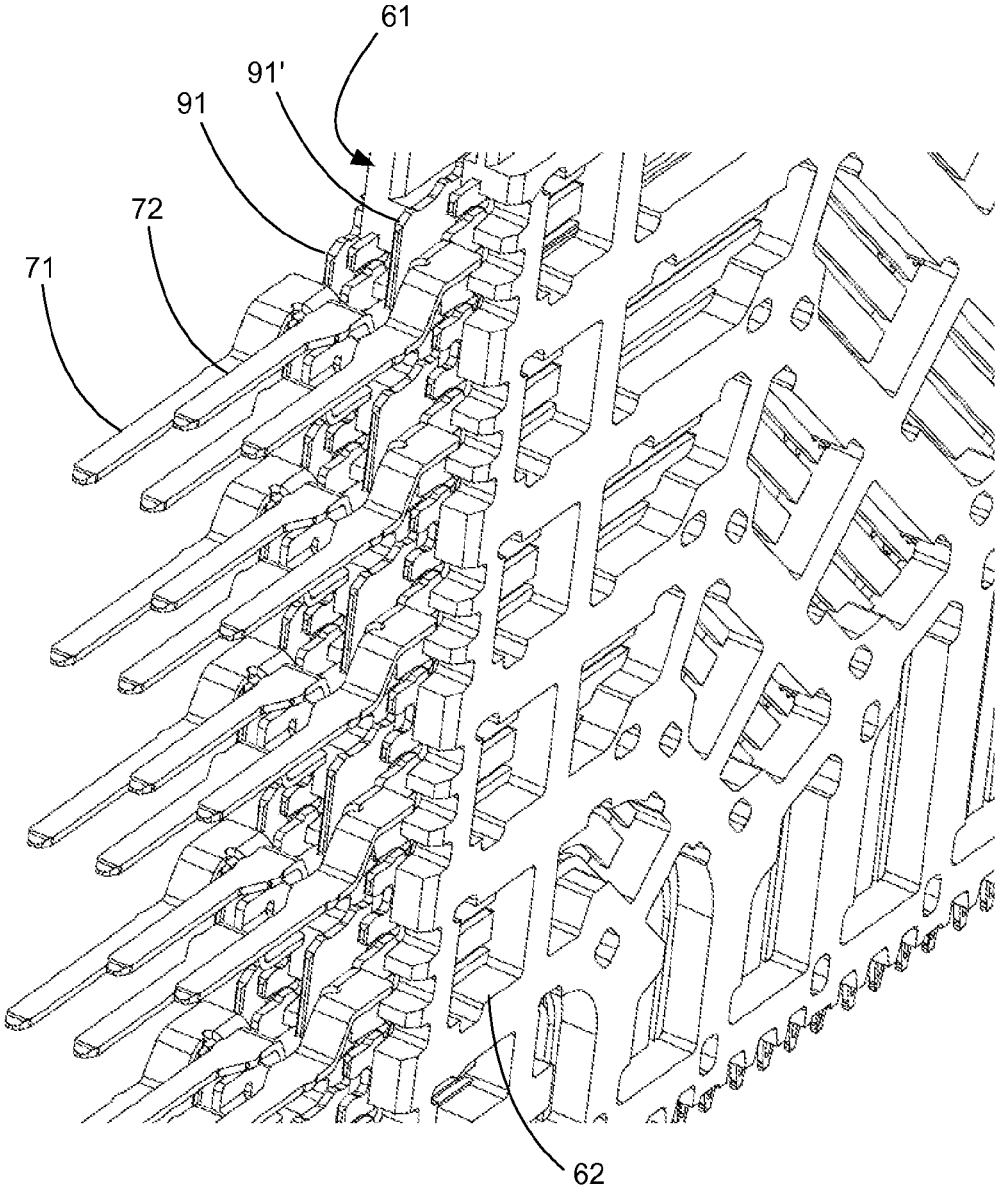
FIG. 8 illustrates a partial perspective view of an embodiment of two adjacent wafers.
Figure 9:
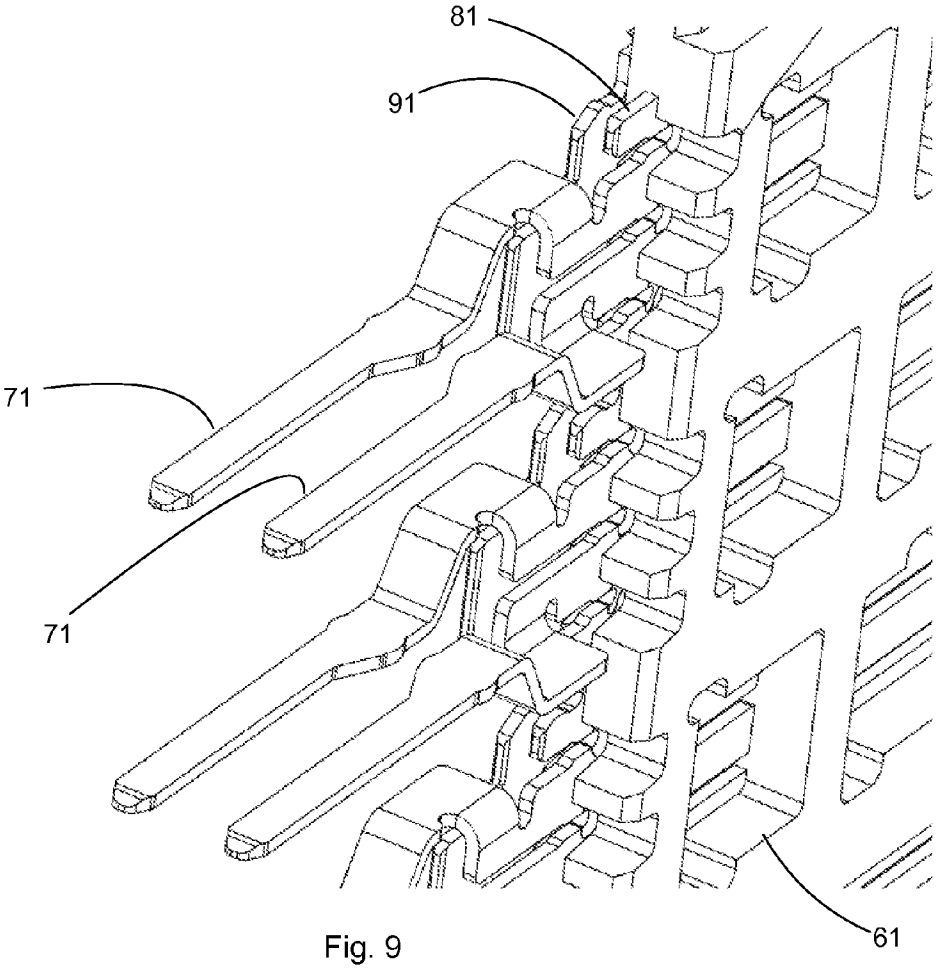
FIG. 9 illustrates an enlarged perspective view of one of the wafers depicted in FIG. 8.
Figure 10:
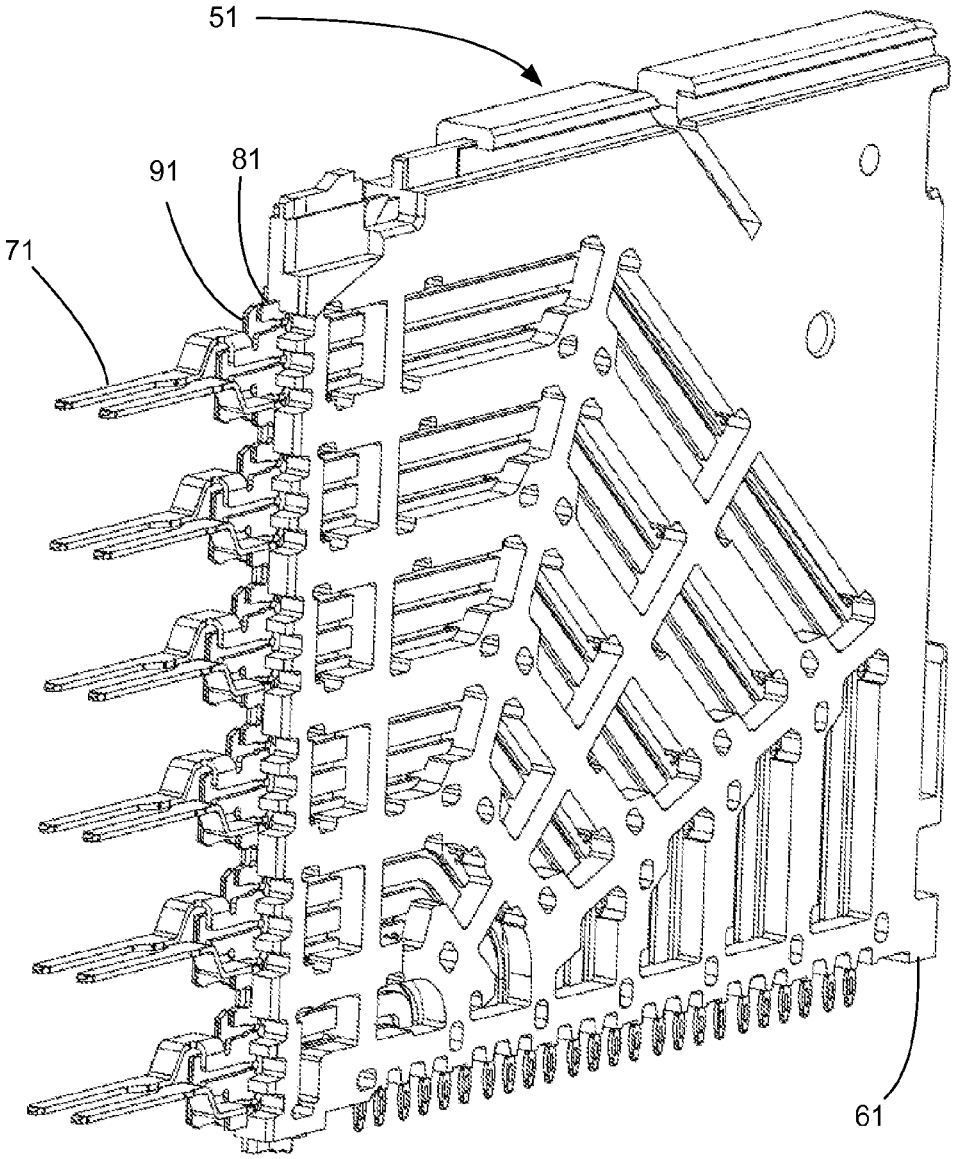
FIG. 10 illustrates a perspective view of an embodiment of a wafer.
Figure 11:
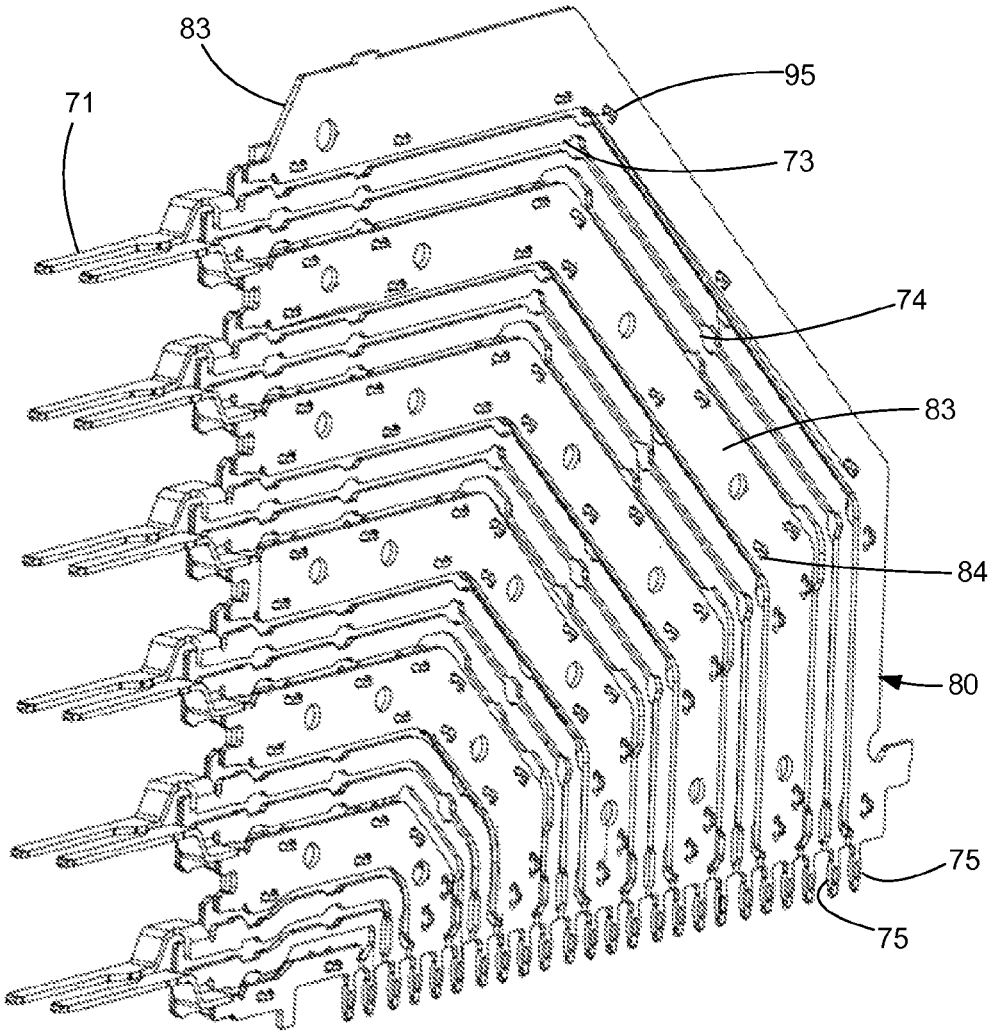
FIG. 11 illustrates a simplified perspective view of the embodiment depicted in FIG. 10.
Figure 12:
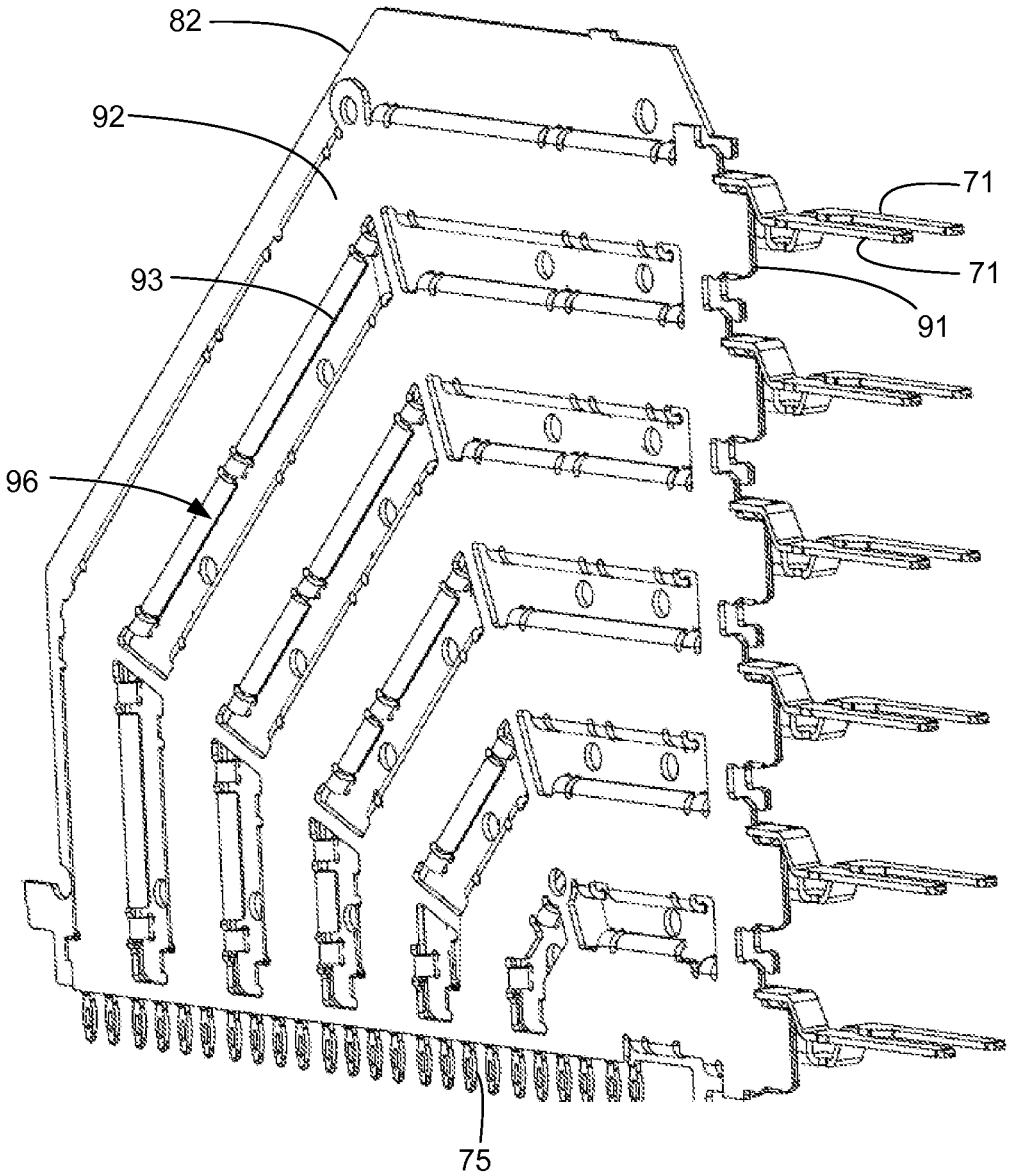
FIG. 12 illustrates another perspective view of the embodiment depicted in FIG. 11.
Figure 13:
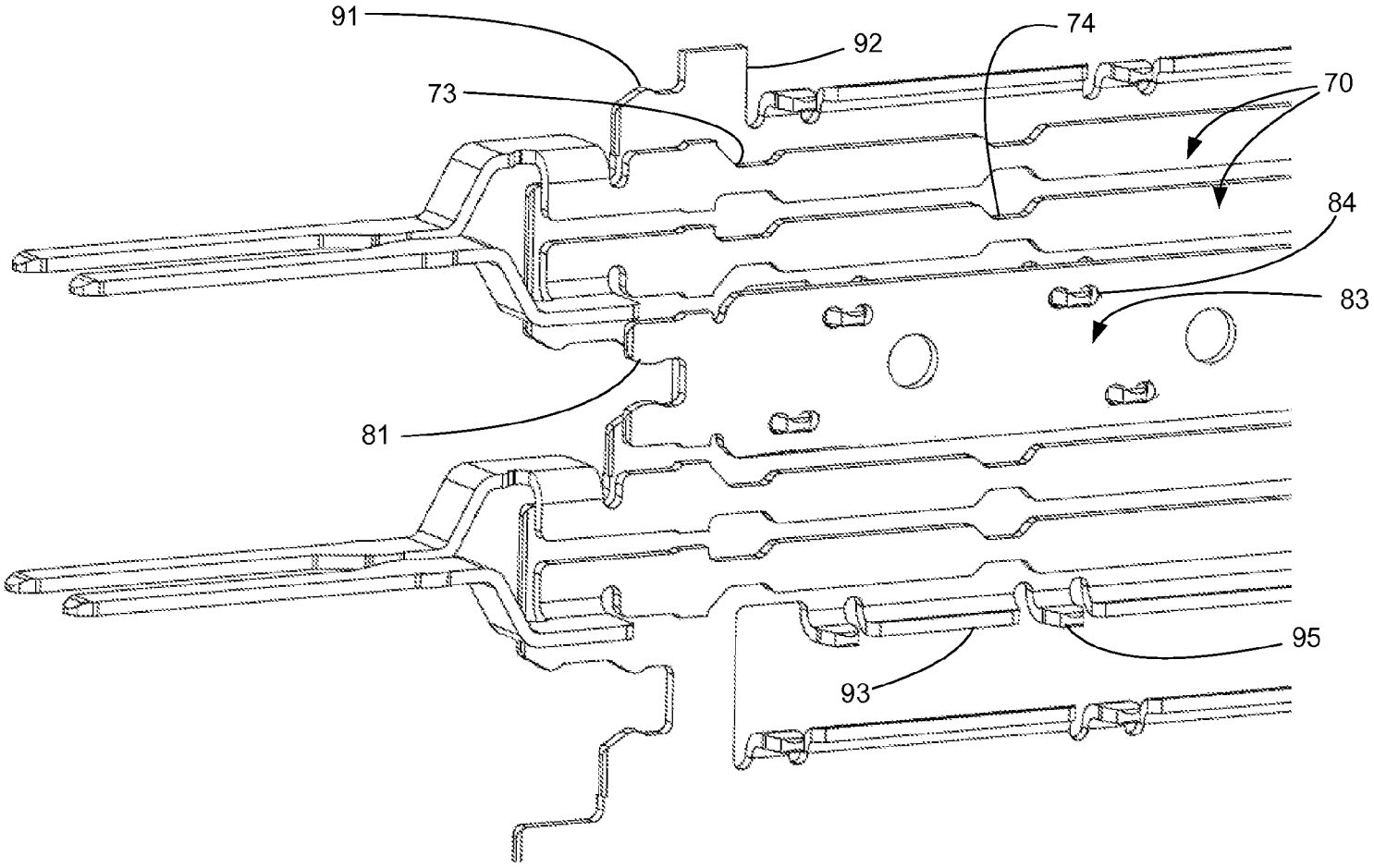
FIG. 13 illustrates an enlarged perspective view of the embodiment depicted in FIG. 11.
Figure 14:
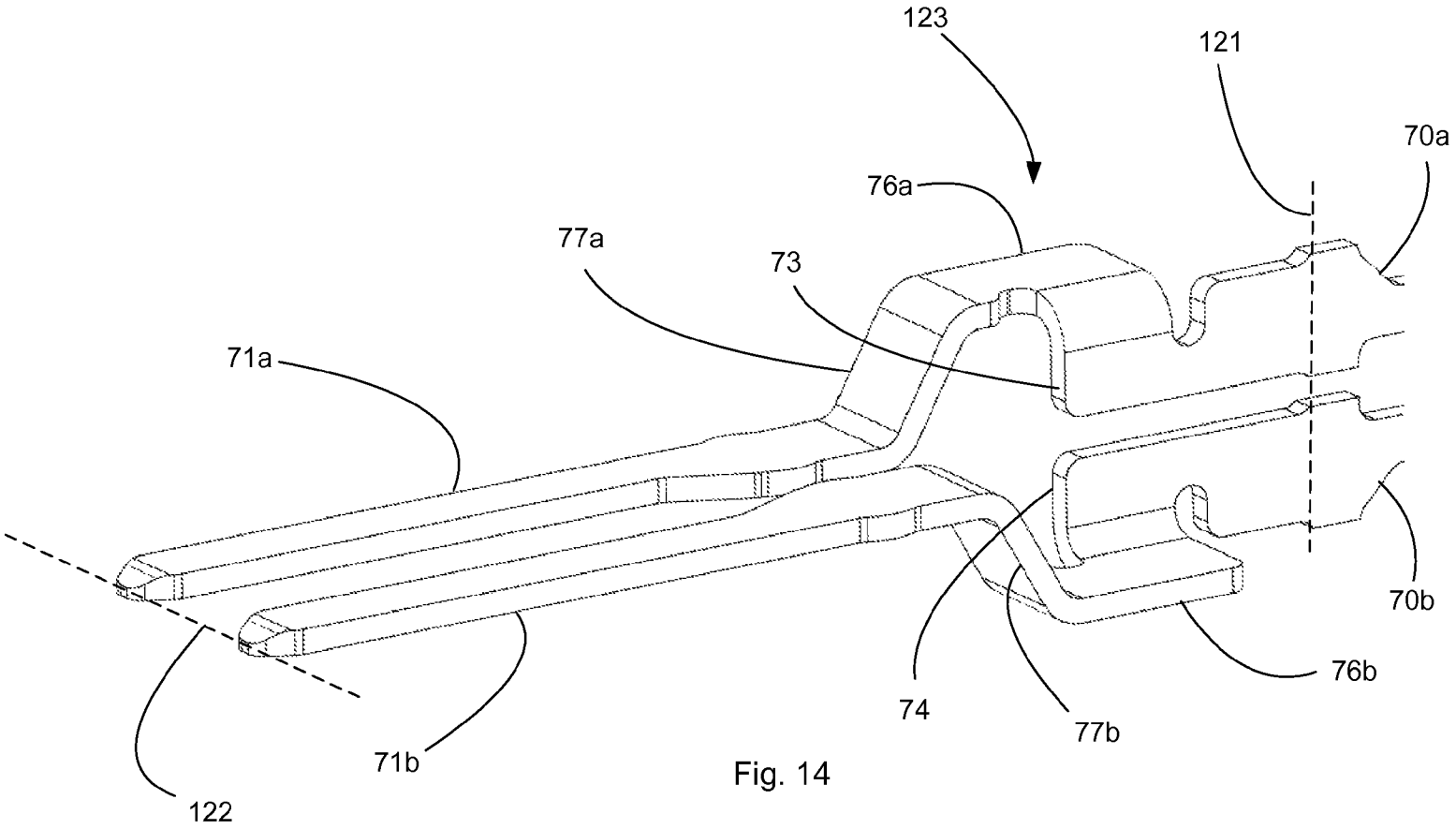
FIG. 14 illustrates a perspective view of a transition area of an embodiment of two terminals configured to provide a differential pair.
Figure 15:
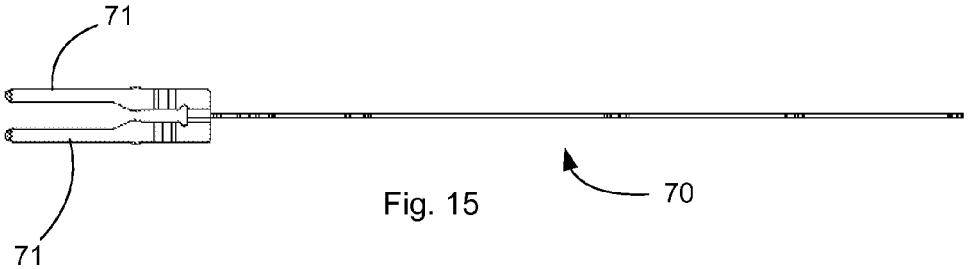
FIG. 15 illustrates a top view of the terminals depicted in FIG. 14.
Figure 16:
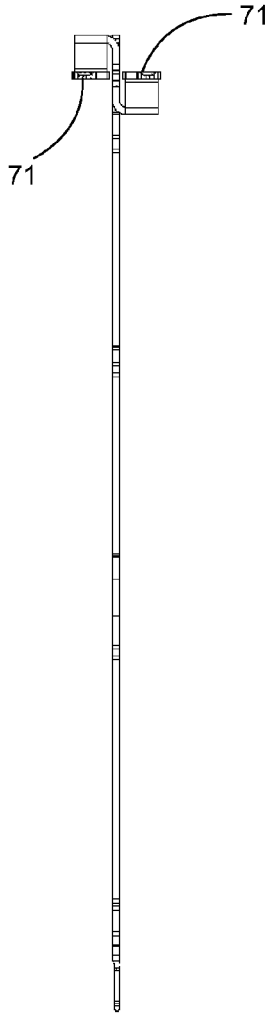
FIG. 16 illustrates an elevated front view of the embodiment depicted in FIG. 15.
Figure 17:
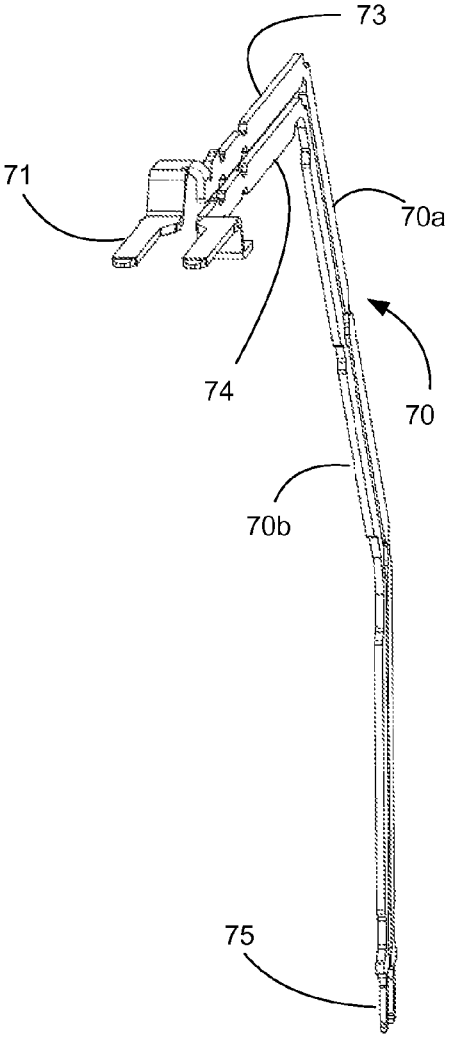
FIG. 17 illustrates a perspective view of the embodiment depicted in FIG. 15.
Figure 18:
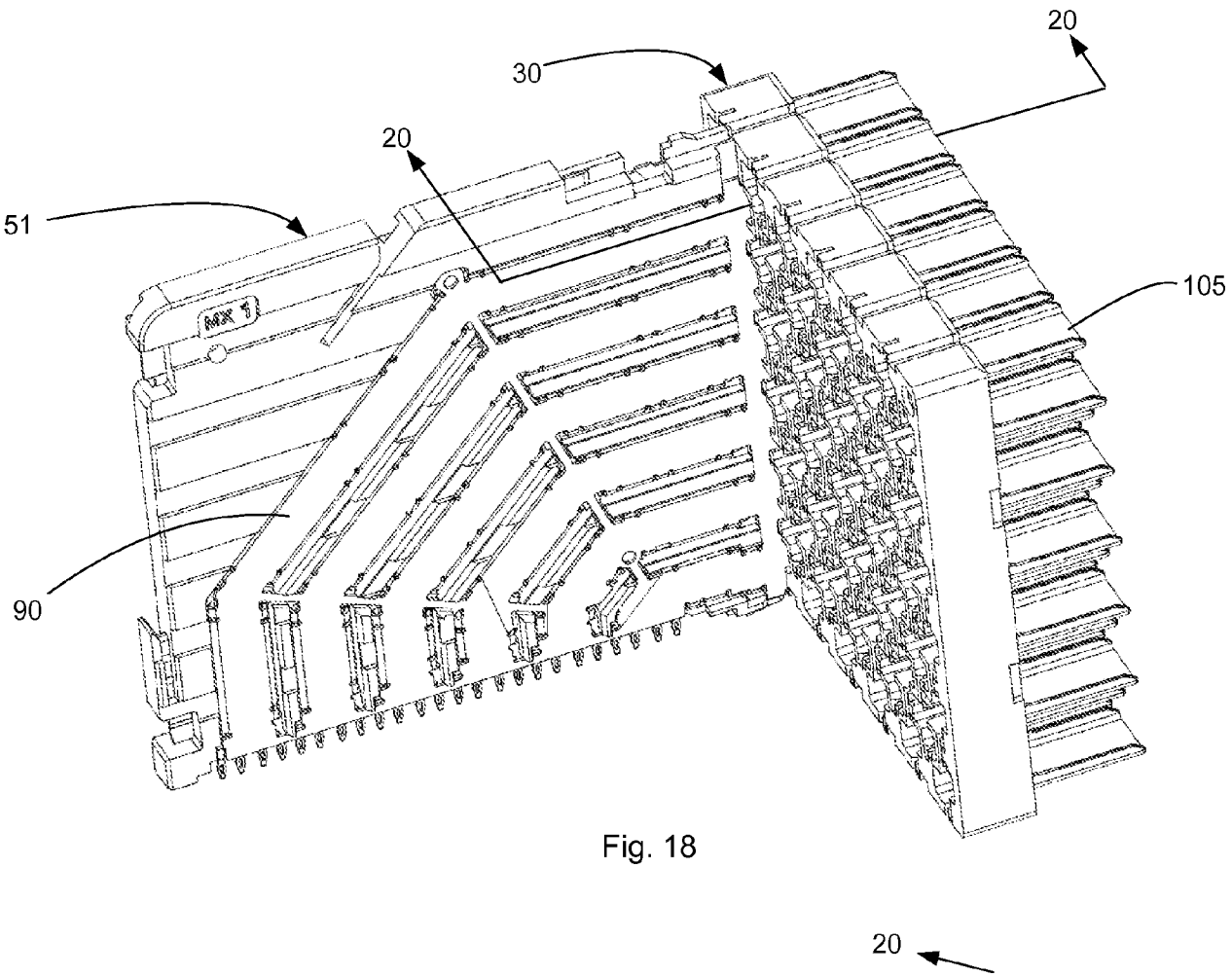
FIG. 18 illustrates a perspective view of an embodiment of a wafer inserted in an insert that also shows u-shields.
Figure 19:
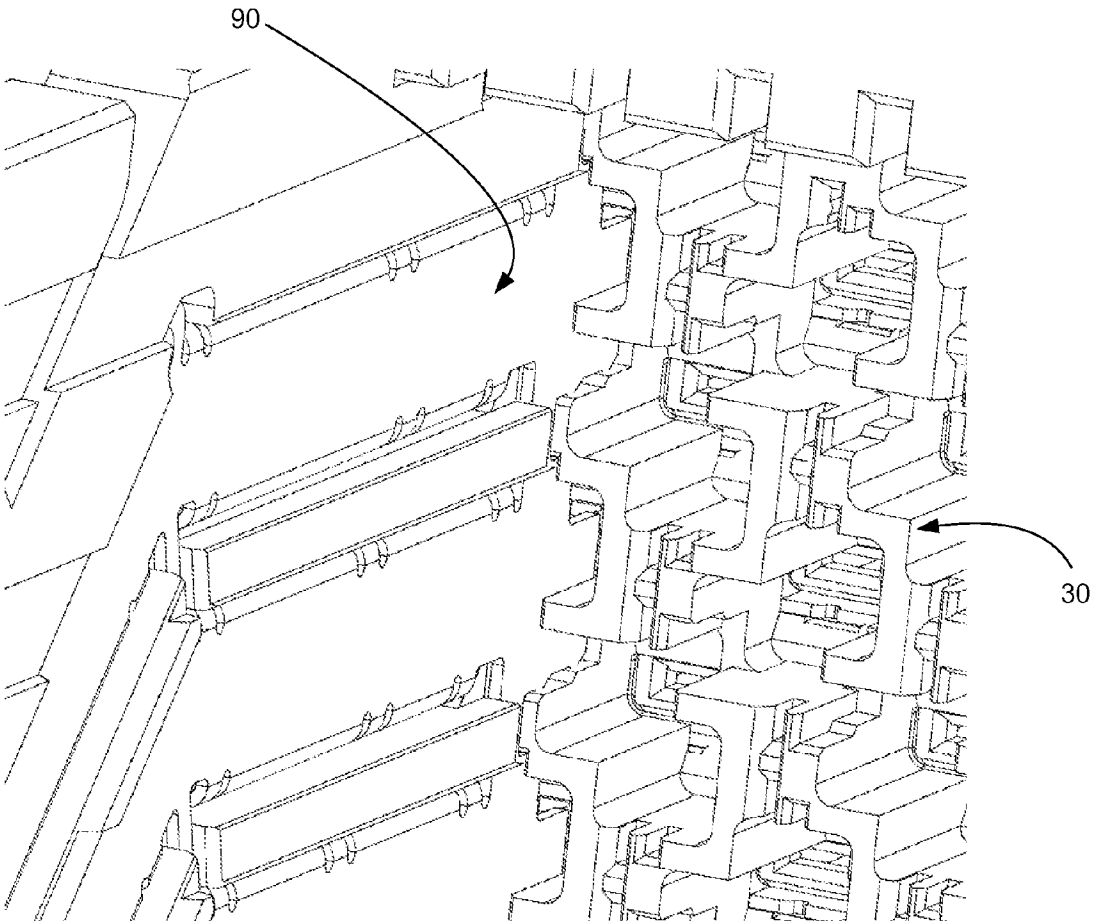
FIG. 19 illustrates an enlarged perspective view of the embodiment depicted in FIG. 18.
Figure 20:
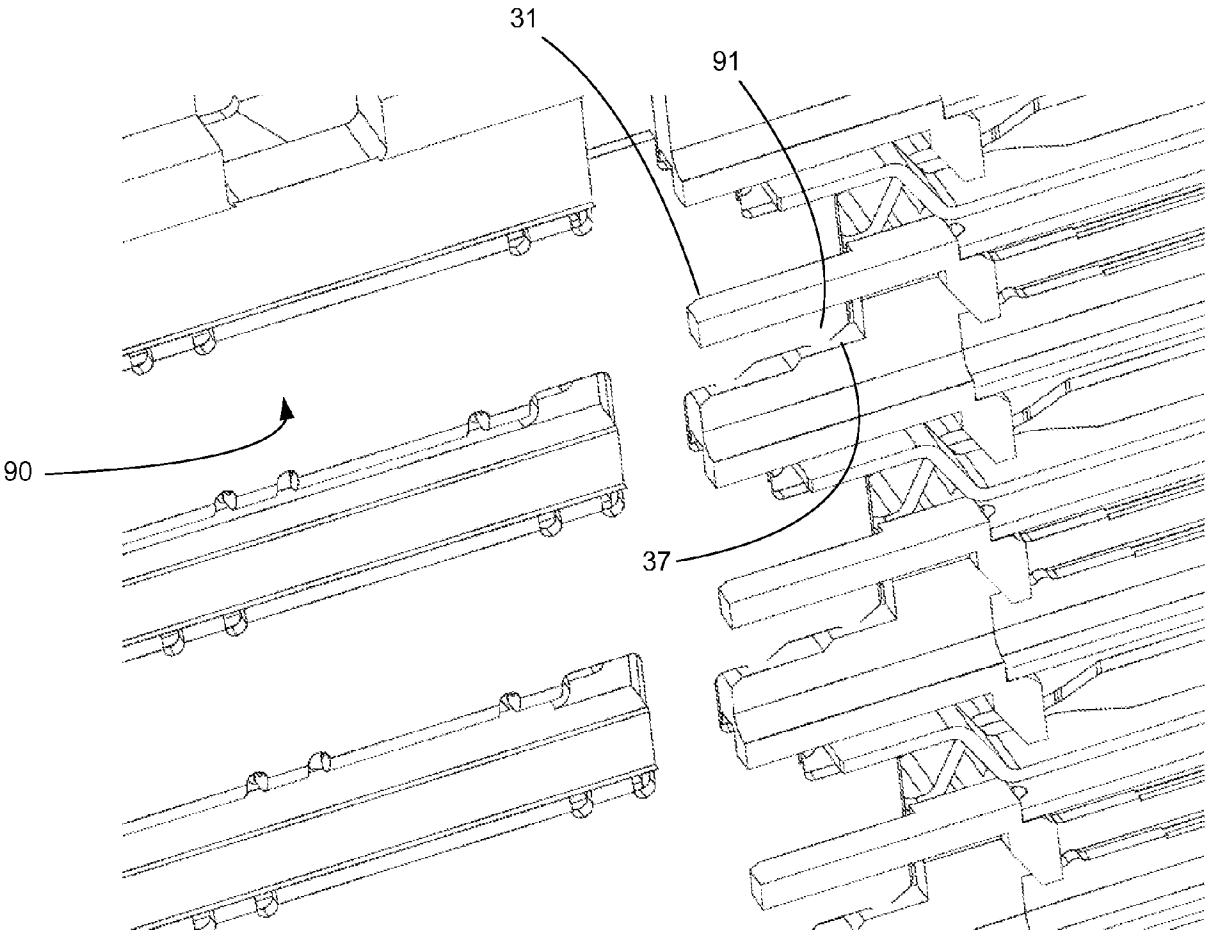
FIG. 20 illustrates a perspective view of a cross section of the embodiment depicted in FIG. 18, taken along line 20-20.
Figure 21:
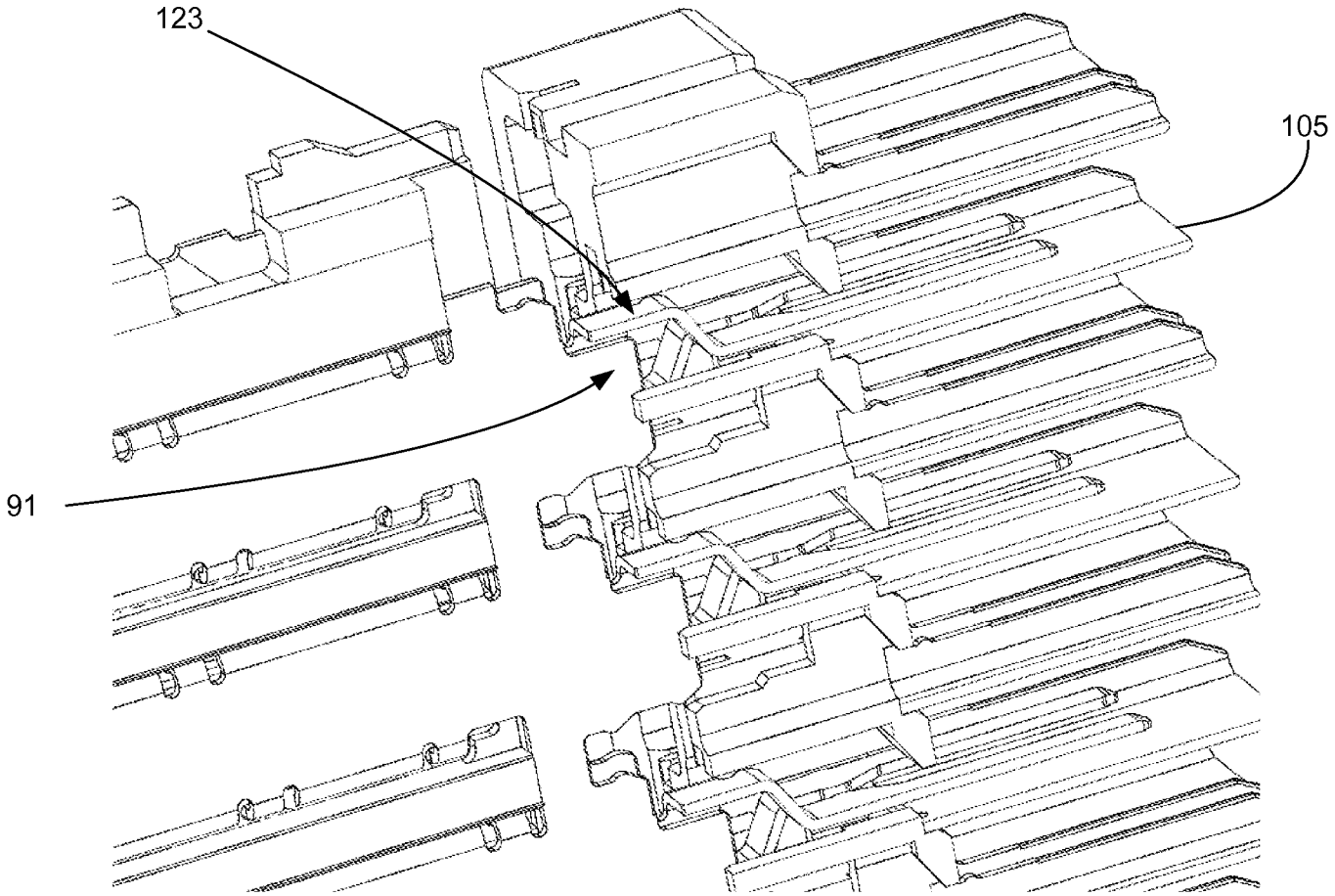
FIG. 21 illustrates another perspective view of the embodiment depicted in FIG. 20.
Figure 22:
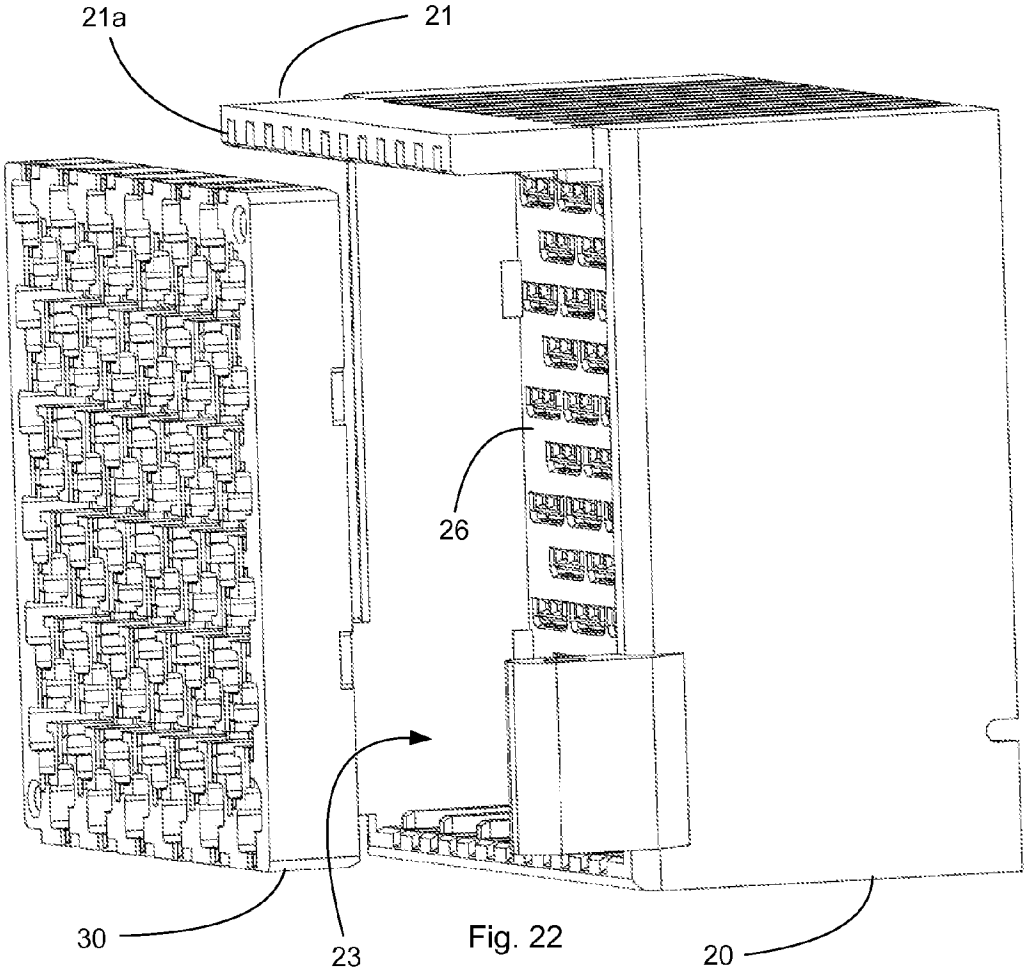
FIG. 22 illustrates a perspective view of an embodiment of an insert and a shroud in an exploded arrangement.
Figure 23:
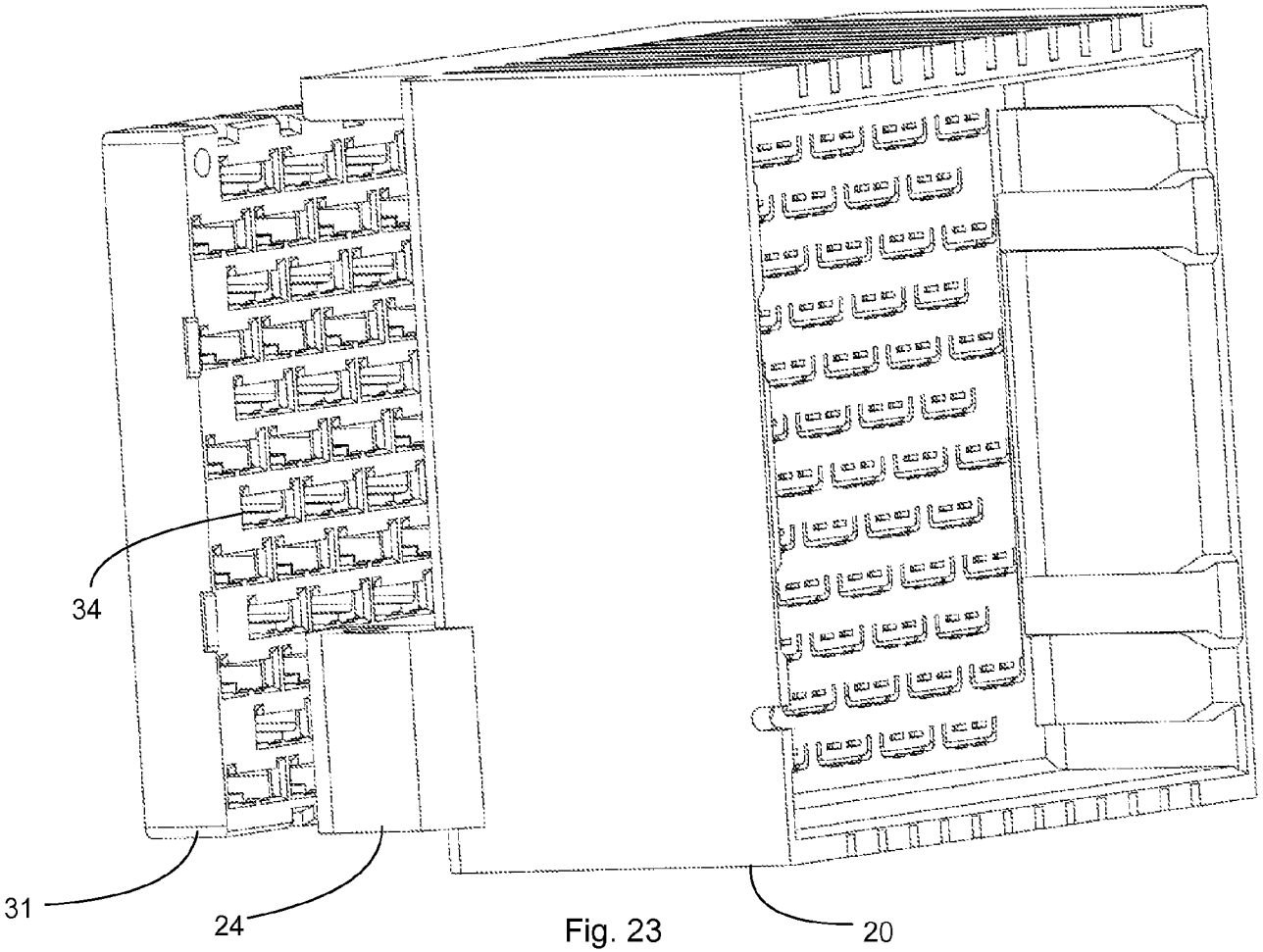
FIG. 23 illustrates another perspective view of the embodiment depicted in FIG. 22.
Figure 24:
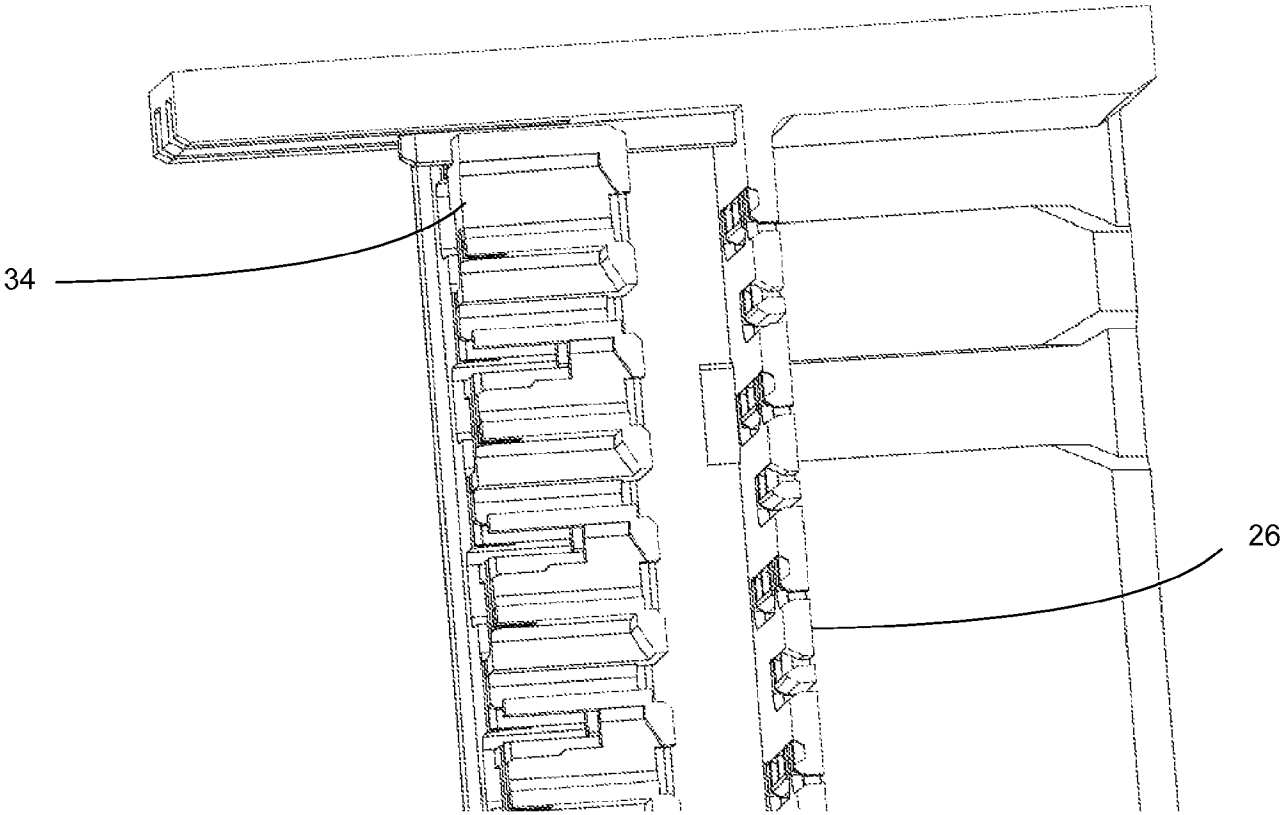
FIG. 24 illustrates a perspective view of a cross section of an embodiment of an insert partially assembled to a shroud.
Figure 25:
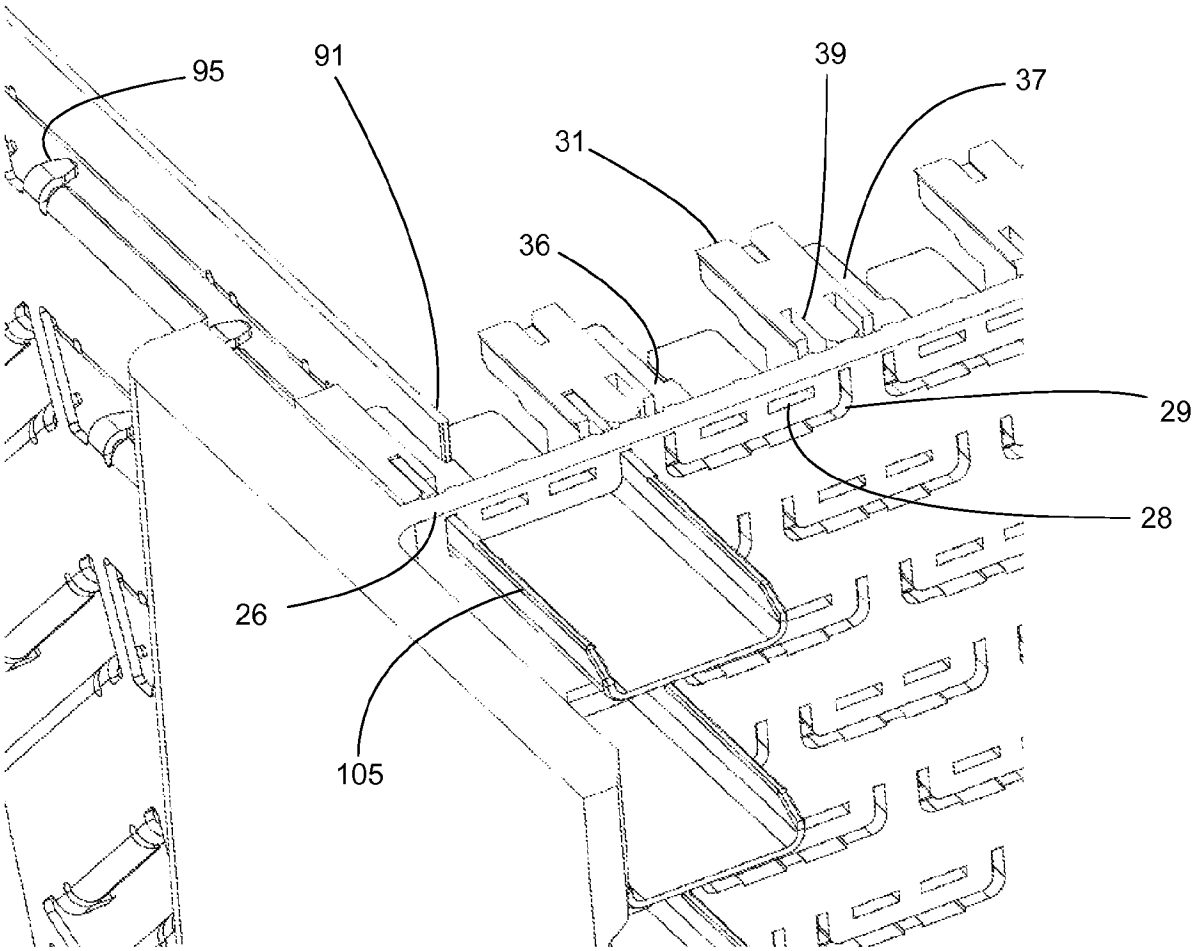
FIG. 25 illustrates a simplified perspective view of a cross section of an embodiment of a wafer inserted into an insert and shroud.
Figure 26:
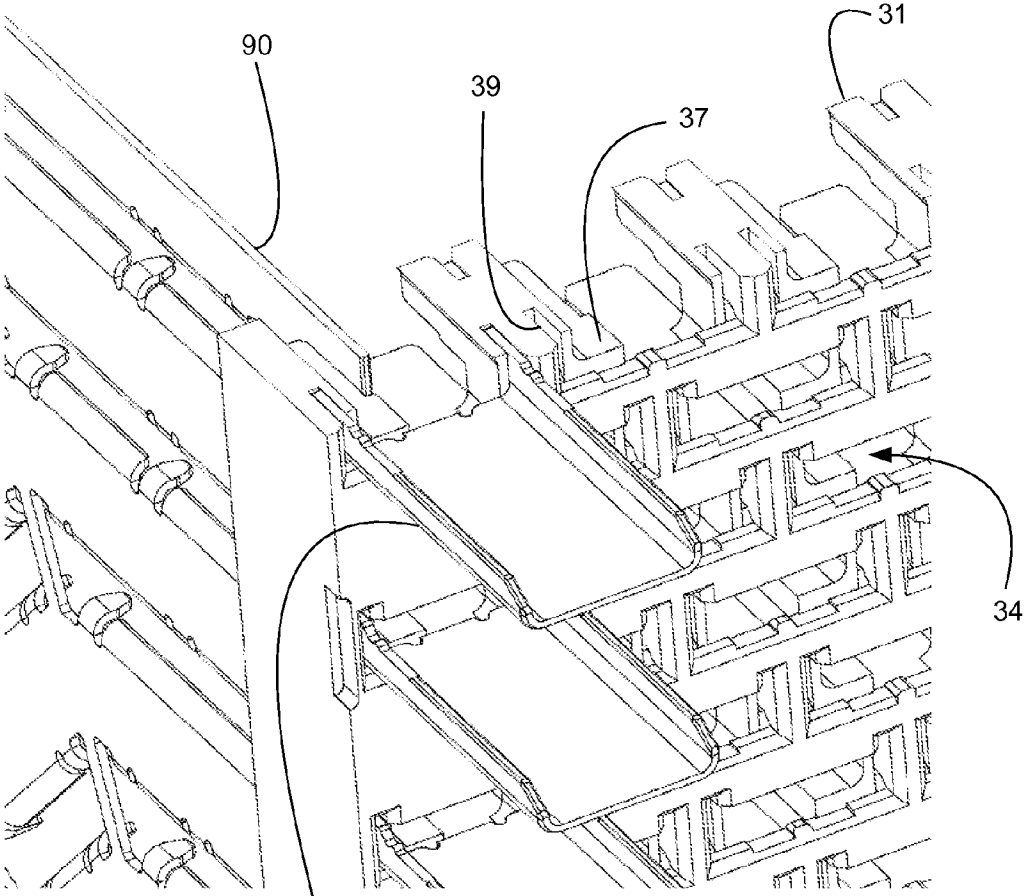
FIG. 26 illustrates a further simplified perspective view of the embodiment depicted in FIG. 25 but with the shroud omitted.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The specification illustrates a number of features that can be used to provide a connector suitable to enable a direct connection between a daughter card and a main board. One feature that is useful is the 90 degree twist or rotation in alignment provided in mating interface. In the body of the connector, a wafer supports a differential pair in a vertical edge-coupled manner and the bodies of the differential pair are aligned in a first plane while the contacts are still edge coupled but are aligned in a second plane that is orthogonal to the first plane. This provides a beneficial continuation of the edge coupling from a first alignment 121 (e.g., a vertical alignment) that is in the first plane and extends along a first imaginary line to a second alignment 122 (e.g., a horizontal alignment) that is in the second plane and extends along a second imaginary line. Between the first and second alignments 121 and 122 is a transition area 123 that first folds the body over and then angles the terminals so that the contacts can be properly aligned. More will be said about this below. Typically such an orientation change is difficult to do in a mating interface that is as compact as would be suitable for backplane connector. Applicants have determined, however, that it is possible to use terminals with blanked and formed contacts and to ensure that features used to alter the orientation of the terminals are carefully controlled (and potentially somewhat of a mirror image of each other) so as to provide desirable electrical performance while shifting from a vertical alignment to a horizontal alignment (the vertical and horizontal alignments being relative to the supporting circuit board).

Because of the compact nature of the mating interface and the need to have signal terminals transition from a vertical arrangement to a horizontal arrangement (so as to provide the 90 degree rotation), there isn't space for convention ground terminal contacts. Thus ground terminals 80 do not have contacts that can engage a u-shield 105 so as to provide a direct electrical connection therebetween (it being understood that the u-shield 105 will engage ground terminals contacts of the mating connector). Normally in a system that is expected to function at high data rates, such an omission would prevent the connector system from working because the break in the ground terminals between the mating connectors would cause a substantial reflection. To prevent such a system breaking occurrence, an insert 30 is placed in a shroud 20. The insert 30 includes conductive surfaces 36 that help electrically connect the ground terminals 80 to the u-shields 105. The insert 30 can connect the ground terminals 80 directly to the u-shield or the insert can connect a shield to the u-shield, while the shield is electrically connected to the ground terminals. Thus, the insert provide for an electrical connection between the ground terminals and the u-shield even though the connection may not be direct (e.g., it passes through one or more intermediary components).

Turning to the Figs, a connector 10 is depicted that includes the shroud 20 that extends around a wafer set 50 mounted to a circuit board 5. The shroud includes a first recess 22 and a second recess 23. The first recess 22 is configured to engage a mating connector. The second recess 23 is configured to engage the wafer set 50. A shroud wall 26 divides the two recesses 22, 23. To help control the alignment of the wafer set 50, the shroud may optionally include a shoulder 21 that includes alignment grooves 21*a* that are configured to engage a portion of the wafers and ensure a proper alignment is made between the wafer set 50 and the shroud 20.

As depicted the wafer set 50 includes two wafers 51 and 52 that are configured to be offset with respect to each other. As can be appreciated, a wafer set can be 2 or more wafers and often will be 4 or more wafers. While the offset configuration is not required, the offset nature of the adjacent wafers allows for a more compact terminal arrangement while providing good electrical isolation and thus is useful. As depicted, each wafer 51, 52 has an insulative frame 51*a*, 52*a* that supports a plurality of edge-coupled signal terminals 70 and a differential pair of signal terminals would include, for example, terminal 70*a* and terminal 70*b*. The frame can include impedance gaps 61 that help tune the individual terminals 70 in a desirable manner so that each differential pairs functions in a desirable manner. The terminals 70 can be formed of conventional materials and the size of the terminals (the thickness and width) can vary depending on the desired impedance of the system (for example, whether the system is tuned for 85 or 100 ohms). As can be appreciated, in a wafer the differential pairs would each be different lengths depending on where in the wafer they were positioned (the terminals at the top of the wafer would be longer then the terminals at the bottom of the wafer). The signal terminals 70 each include a contact 71, 72, a body 73, 74 and a tail 75. As can be appreciated, the bodies of the signal terminals 70 have an average width and a ground terminal 80 is positioned between the two vertically arranged signal terminals that form the differential pairs provided by the respective wafer, the ground terminal being wider than the signal terminal.

In an embodiment a shield 90 is provided on one side of the wafer 51, 52 and the shield 90 helps provides isolation between terminal pairs in adjacent wafers and because the shield 90 commons the ground terminals 80 with fingers 95 that engage ground terminal apertures 84, the shield 90 also helps reduce cross-talk between terminals in the same wafer. To further improve performance, signal terminals in adjacent wafers can be offset (as noted above). As can be appreciated, the shield 90 includes shield cutouts 96 provided by rolled edges 93 and fingers 95 and the shield cutouts 96 are aligned with the body 83 of the ground terminals 80. Thus the cutouts 96 can help manage the impedance of the ground terminals 80. The shield 90 includes contacting portions 91, 91' that configured to engage insert 30 (as will be discussed below). As depicted, the top ground terminal 80 extends above the shield 80 and this is beneficial from a construction standpoint but is not required.

Each of the signal terminals 70 that form a differential pair include the contact 71, 72 and the contacts 71 that make up the differential pair are configured to be edge coupled (just like the bodies 73, 74) but the contacts 71, 72 are spaced apart from each other a greater distance than the bodies 73, 74. The contacts 71, which are horizontally aligned, are positioned in the insulative shroud 20 (the contacts 71 extending through signal channels 28 in the shroud wall 26). As can be appreciated, merely having contacts arranged in such a compact configuration would be problematic from a cross-talk standpoint, particularly at higher data rates. To minimize cross-talk, a u-shield 105 can be inserted in u-channel 29 of the shroud wall 26 adjacent the contacts 71. The u-shield 105 can be formed of a suitable alloy (such as a copper alloy) and is intended to connect to mating terminals of a mating connector (not shown). As can be appreciated, the u-shield 105 extends on both sides of the shroud wall 26.

As noted above, because of the compact nature of the mating interface, the ground terminals 80 have an engaging portion 81 but do not have contacts that can engage the u-shield 105 so as to provide a direct electrical connection therebetween. To provide an electrical connection between the u-shield 105 and the ground terminals 80, the insert 30 is provided. The insert 30 includes a base 31 that is insert molded but the base 31 has a conductive area 36 positioned in a and the conductive area is electrically conductive. The conductive area 36 can be provided by doing a two-shot mold with an insulative resin and a resin that is either conductive or can be made conductive through a suitable plating process. Naturally, if the plating can be selectively applied than a single resin could also be used and the plating could be positioned where desirable. Furthermore, if desired one could design a terminal that could be insert molded into the resin so as to provide the desired insulative and conduction portions. Thus, the method of forming the insert 30 is not intended to be limiting. Given the likely complicated geometry, it is expected that a two-shot molding process with the second resin either being conductive or plateable will be the most effective construction.

The engaging portion 81 of the ground terminals 80 can directly engage the conductive area 36 on the insert 30. Alternatively, the ground terminals 80, which are electrically connected to the shield 90 via the fingers 95, can omit any direct connection to the conductive area 36. Instead the shield 90 can engage the conductive area 36 with contacting portions 91. As the conductive area 36 is electrically connected to the u-shield 105, the ground terminals 80 can be electrically connected to the u-shield 105 via one or two intermediate structures.

The depicted insert 30 is positioned in the second recess 23 of the shroud 20 and includes insert channels 34 that provide a path for the signal terminals to extend through the insert. As noted above, portions of the insert channels 34 have conductive area 36 that operative to couple the shield 90 (and the ground terminal 80 if so configured) to the u-shield 105. The conductive area 36 does not contact the signal terminals termials. The depicted insert 30 includes notch 39 (which can be u-shaped) to engage the u-shield 105 and engagement surface 37 to engage the contacting portion 91 of the shield 90. The conductive area 36 can extend into the notch 39 and on the engagement surface 37, thus in an embodiment at least a portion of the notch 39 and the engagement surface 37 are part of the conductive area 36.

As depicted, the contacts 71 (which are in a horizontal alignment) extend through insert channels 34 in the insert 30 and are supported by the signal channels 28 in the shroud wall 26 without contacting the insert 30. The shroud 20 thus helps control the position of the contacts 71 so that they can engage a mating connector in a reliable manner. The u-shield 105 is positioned in the u-channel 29 so that the u-shield 105 at least partially surrounds the contacts 71 on three sides. As can be appreciated and discussed elsewhere, adjacent rows of horizontally aligned contacts are offset so as to provide the desired electrical performance while maintaining pin field density.

As can be appreciated, transitioning from a vertical alignment to a horizontal alignment while preserving signal integrity is not easy to do. The depicted embodiment uses a mirror image forming operation that folds the top of the body 73 of terminal **70*a* (which was in the first plane) in a first direction while folding the bottom of the body 74 of terminal 70*b* in a second direction (the first and second directions being opposite). The forming operation provides a first horizontal ledge 76*a* and a second horizontal ledge 76*b* that are parallel but offset both vertically and horizontally. An angled ledge 77*a* brings the terminal 70*a* down to the second plane and the contact 71*a* extends along the second plane in the second alignment 122 (e.g., the horizontal alignment). Angled ledge 77*b* brings terminal 70*b* up to the second plane and the contact 71*b* extends along the second plane in the second alignment 122. Thus, the terminals that form a differential pair have a transition area 123 where the top terminal is folded left and down and the bottom terminal is folded right and up (e.g., the terminals that form the differential pair are formed oppositely through the transition area 123**). Naturally, the first form of the top and bottom terminal could be folded in the opposite direction of what is depicted (e.g., the top terminal could be folded right instead of left and the bottom terminal could be folded left instead of right).

As can be appreciated from the above disclosure, in an embodiment the most direct electrical path from the ground terminal to the u-shield is from the ground terminal to the shield and then to the conductive area and then to the u-shield. It is expected that do to the limited number of mating cycles such a configuration should provide a reliable low resistance electrical connection between each of the conductive mediums while avoiding issues with large changes in impedance. Thus, the depicted embodiment can provide 90 degrees of rotation about two different axes when comparing the mating side to the mounting side.

As can be further appreciated, therefore, in an embodiment a plurality of pairs of signal terminals are supported by the connector and each of the pairs is arranged in an edge-coupled first alignment (which can be a vertical alignment). Each of the signal terminals includes a contact and a ground terminal is positioned between each pair of signal terminals, the ground terminal and the signal terminals arranged in the first alignment (e.g., in a first plane). A shroud is provided with a first recess and the shroud supports the contacts. The contacts of each pair of signal terminals can be arranged in an edge-coupled second alignment in the first recess. As can be appreciated, the first alignment can be 90 degrees different than the second alignment. A u-shield is supported by the shroud and is electrically connected to the ground terminal, however the u-shield and the ground terminal are not in direct physical contact. In an embodiment, the shroud supports an insert that helps provide an electrical connection between the ground terminal and the u-shield.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. An electrical connector, comprising:

a plurality of wafers, each with a mounting side and a mating side, each wafer including a first pair and a second pair of signal terminals with a ground terminal positioned between the first and second pairs, each of the terminals of the pair of signal terminals having a tail, a body and a contact, wherein the tails of the terminals in the wafer are arranged in a row on the mounting side and the bodies of the terminals are aligned in a vertical alignment such that the body of the ground terminal is between the bodies of the two pairs of signal terminals and the contacts of each pair of signal terminals are in a horizontal alignment, each wafer further including a shield that is electrically connected to the ground terminal;

a shroud positioned on a mating side of the wafers, the shroud being insulative and including insert channels that support the contacts of the pair of signal terminals in a side-by-side arrangement;

a plurality of u-shields extending through u-shaped apertures in the shroud, the u-shields each configured to partially shield a respective pair of contacts; and an insert positioned in the shroud, the insert configured to electrically connect the u-shield to at least one of the ground terminal and shield.

2. The connector of claim 1, wherein each of the pairs of signal terminals has a transition area between the vertical aligned body and the horizontal aligned contacts.

3. The connector of claim 2, wherein the transition area has one of the signal terminals fold in a first direction and the other of the signal terminals fold in a second direction that is opposite the first direction.

4. The connector of claim 3, wherein the insert includes a notch that engages the u-shield.

5. The connector of claim 4, wherein the insert has a conductive area that extends into the notch and the u-shield is electrically connected to the at least one of the ground terminal and the shield via the conductive area.

6. The connector of claim 5, wherein the ground terminal does not have a contact.

7. The connector of claim 6, wherein the ground terminal is electrically connected to the u-shield via the shield and the ground terminal does not electrically connect directly to the insert.

8. The connector of claim 6, wherein the shield is connected to the conductive surface so that the electrical path between the ground terminal and the u-shield goes through at least the shield and the conductive area.

9. An electrical connector, comprising:

a plurality of pairs of signal terminals, each of the pairs arranged in an edge-coupled first alignment, each of the signal terminals including a contact;

a ground terminal positioned between each pair of signal terminals;

a shroud with a first recess supporting the contacts, the contacts of each pair of signal terminals being arranged in an edge-coupled second alignment in the first recess, the first alignment being 90 degrees different than the second alignment; and a u-shield supported by the shroud and electrically connected to the ground terminal, wherein the u-shield and the ground terminal are not in direct physical contact.

10. The connector of claim 9, wherein the ground terminal does not have a contact.

11. The connector of claim 10, wherein the shroud includes a second recess and the connector further includes an insert positioned in the second recess, the insert helping to electrically connect the ground terminal to the u-shield.

12. The connector of claim 11, wherein the u-shield extends through a shroud wall that separates the first recess from the second recess and the insert includes a notch that is configured to engage the u-shield.

13. The connector of claim 12, wherein the insert includes an conductive area that extends into the notch so as to electrically connect to the u-shield, the conductive area helping to provide the electrical connection between the u-shield and the ground terminal.

14. The connector of claim 13, wherein the connector further includes a shield and the shield provides an electrical connection between the ground terminal and the conductive area.

15. The connector of claim 14, wherein the ground terminal does not make direct electrical connection with the conductive area.

* * * * *